United States Patent [19]

Tada et al.

[11] 3,931,430

[45] Jan. 6, 1976

[54] METHOD OF DESENSITIZING A PRESSURE SENSITIVE RECORDING SHEET AND THE PRODUCT THEREOF

[75] Inventors: Tomonori Tada; Akira Shiono, both of Osaka, Japan

[73] Assignee: Kanzaki Paper Mfg. Co. Ltd., Tokyo, Japan

[22] Filed: Nov. 7, 1973

[21] Appl. No.: 413,437

[30] Foreign Application Priority Data

Nov. 11, 1972 Japan ..... 47-113377

[52] U.S. Cl. ..... 428/195; 427/146; 427/150; 427/151; 428/211

[51] Int. Cl.[2] ..... B41M 5/02

[58] Field of Search ..... 117/36.7, 36.8; 427/146, 427/150, 151; 428/195, 199, 211

[56] References Cited

UNITED STATES PATENTS

| | | | |
|---|---|---|---|
| 2,654,673 | 10/1953 | Steinhardt | 106/22 |
| 2,730,456 | 1/1956 | Green et al. | 117/36.1 |
| 2,730,457 | 1/1956 | Green et al. | 117/36.8 |
| 3,809,668 | 5/1974 | Yarian | 260/33.4 U |

*Primary Examiner*—Thomas J. Herbert, Jr.
*Assistant Examiner*—Bruce H. Hess
*Attorney, Agent, or Firm*—Cushman, Darby & Cushman

[57] ABSTRACT

The pressure sensitive recording sheet is partially desensitized by applying an improved desensitizer to a predetermined area thereof. The improved desensitizer comprises a reaction product produced by the reaction of ammonia, amines, diamines or polyamines with glycidyl esters or glycidyl ethers. The improved desensitizer is hydrophobic and soluble in an oil vehicle.

9 Claims, No Drawings

METHOD OF DESENSITIZING A PRESSURE SENSITIVE RECORDING SHEET AND THE PRODUCT THEREOF

BACKGROUND OF THE INVENTION

This invention relates to a method of desensitizing a pressure sensitive recording sheet and more particularly, to spot-desensitizing of a sheet sensitized with organic or inorganic color forming reactant acid materials which act as electron acceptor in an electron-donor-acceptor color-forming reaction. The invention also relates to desensitized sheets obtained by such desensitization.

There are known several types of pressure-sensitive recording system utilizing an electron donor-acceptor color-forming reaction between a colorless chromogenic material and a color forming reactant acid material. The colorless chromogenic material and the color forming reactant acid material are hereinafter referred to as "color former" and "color acceptor", respectively. Those pressure-sensitive recording systems comprise a support sheet having, disposed on at least one surface thereof, micro capsules containing oil droplets in which a color former is dissolved and/or a color acceptor capable of producing color when brought into reactive contact with the color former.

For example, U.S. Pat. No. 2,730,456 discloses a transfer-copy system wherein minute oil droplets in which a color former is dispersed or dissolved are encapsulated and coated onto a transfer sheet. The color former is thereafter transferred to a receiving sheet by rupturing said capsules. The underlying receiving sheet has a color reactant coating thereon containing a color acceptor which will react with the color former causing a visible colored mark at points where the microcapsules have been ruptured and the color former has been transferred. In case when multiple copies are needed at least one intermediate copy sheet having said microcapsules and said color acceptor on the opposite surfaces thereof, respectively, is interposed between the upper copy sheet and the underlying copy sheet.

U.S. Pat. No. 2,730,457 discloses another type of a pressure-sensitive record sheet. In this pressure-sensitive record sheet, there are disposed on one surface of the same sheet both the color acceptor and the capsules containing oil droplets in which the color former is dissolved. This record material is known as a "self contained" system.

It is known to locally apply a desensitizer in advance onto the color-acceptor-coated surface in order to inactivate color-forming reactivity of the color former on the area where color-forming reaction is not required. The desensitizer may also be applied locally onto the color-acceptor-coated surface where a color image has been produced in order to erase the image.

Desensitizers which have been conventionally used are polyethylene glycol, glycerol, dodecyl trimethylammonium chloride, dodecyl amine, dodecyl dimethylamine, N,N-bispolyoxyethylene alkylamine, N,N,N-trispolyoxyethyleneamine, N,N,N'-trispolyoxyethylene N-alkylenediamine, N,N,N',N',-tetrakispolyoxyethylene alkylenediamine, N-alkyl-N,N',N',-trimethylalkylenediamine, etc. Among those desensitizers, ethylene oxide adducts of amine, diamine and polyamine are particularly superior in the desensitizing effect, but those adducts are not suitable for offset printing because hydrophobic vehicle can not be used in making ink due to many hydrophilic groups of those adducts. In case that the pressure-sensitive recording sheet which is desensitized with the above mentioned adducts is placed in the condition of a high temperature and a high humidity, hygroscopic phenomenun by hydrophilic desensitizer becomes more remarkable and therefore the desensitizer applied onto the area where color-forming reaction is required migrates so far to the adjacent areas where color-forming reaction is not required, with the result that the ability of color-forming reaction at such the adjacent areas is lowered. In addition, as capsules on the back surface or the adjacent sheet are left in the extroadinary high humidity because of the hygroscopic property thereof, the spontaneous rupture of capsules will occur easily.

Recently, organic compounds such as aromatic carboxylic acids or polymers of organic acids such as phenol-formaldehyde resin which are more hydrophobic than inorganic solid acids have been used as color acceptor. For example, DT-OS 2147585, 2152765 and 2242250 disclose that the mixture of aromatic carboxylic acid derivatives such as benzoic acid, salicylic acid or derivatives of which with metal compounds such as metal oxide, metal hydroxide and metal carbonate; or metallic salts of above aromatic carboxylic acid derivatives can be used as color acceptor. It is also suggested in DT-OS 2148427 to use the mixture or copolymer of aromatic carboxylic acid, and aldehyde or acetylene with metallic compounds, and in DT-PS 2152763 to use metallic salts of the said polymer.

The above-mentioned conventional desensitizers are disadvantageous in that they remain sticky for a long time because of the poor affinity for the said organic acids and polymers thereof. Long chain alkyl-dimethyl amine and N-long chain alkyl-N,N',N'-trimethylalkylenediamine are rather hydrophobic but they have an undesirable smell inherent to amines. Especially, long chain alkyl dimethylamine does not show a satisfactory disensitizing effect.

The primary object of the invention is to provide a new and improved method for desensitizing a pressure sensitive recording sheet in which the above mentioned disadvantages with conventional desensitizers can be avoided and an excellent desensitizing effect is obtained.

Another object of the invention is to provide a new desensitizer which is hydrophobic and well soluble in oil vehicle to make an ink for offset printing use.

A further object of the invention is to provide an improved desensitizer which has a good affinity to the color acceptor coating layer which is made of an organic acid or polymer thereof.

A still further object of the invention is to provide an improved desensitizer ink which is superior in both inksetting and migration-resistance.

One of other objects of invention is to provide an improved desensitizer for the pressure sensitive recording sheet which is odorless.

It is also one of the objects of the invention to provide a partly desensitized, pressure sensitive recording sheet in which migration of the desensitizer applied to the sheet hardly occurs even in condition of a high temperature and a high humidity so that capsules containing oil droplets may be prevented from spontaneous rupture at the area adjacent to the area to which the desensitizer is applied.

SUMMARY OF THE INVENTION

According to the invention the pressure sensitive recording sheet is desensitized by applying an improved desensitizer to a predetermined area thereof. The improved desensitizer comprises a reaction product produced by the reaction of ammonia, primary or secondary monoamines, primary or secondary diamines, or, primary or secondary polyamines with glycidyl esters or glycidyl ethers. The desensitizer is preferably applied in the form of an ink with an oil vehicle to a predetermined area of the pressure sensitive recording sheet.

The area of a pressure sensitive recording sheet to which the desensitizer according to the invention is applied is completely desensitized so that no color image is produced at this area even if any pressure is applied thereto. The reaction products produced by adding glycidyl esters or glycidyl ethers to active hydrogen of ammonia, monoamines, diamines and polyamines have an unexpectedly excellent desensitizing function. The above mentioned reaction products becomes more hydrophobic and more soluble in oil vehicles according as the molecular weight increases. Accordingly it is possible to prepare an ink for offset printing use by dissolving any of those reaction products in an oil vehicle. The reaction products according to the invention have a good affinity to the color acceptor coating layer which is made of an organic acid or polymer thereof and are superior in both ink-setting and migration-resistance. The reaction products described are odorless.

In the pressure sensitive recording sheet which is partly desensitized according to the invention, migration of the desensitizer applied to the sheet hardly occurs even in condition of a high temperature and a high humidity so that capsules containing oil droplets may be prevented from spontaneous rupture at the area adjacent to the area to which the desensitizer is applied.

DETAILED DESCRIPTION OF THE INVENTION

According to the invention a reaction product produced by adding glycidyl esters or glycidyl ethers to active hydrogen of ammonia, primary or secondary monoamines, primary or secondary diamines, and, primary or secondary polyamines. Among the reactant amines there may be primary or secondary alkylamine, primary or secondary alkenylamine, primary or secondary cyclicamine, primary or secondary arylamine, etc. Particularly and preferably they are exemplified by methylamine, dimethylamine, ethylamine, diethylamine, butylamine, dibutylamine, allylamine, diallylamine, cyclohexylamine, cyclopentylamine, benzylamine, ethylenediamine, propylenediamine, hexamethylenediamine, diethylenetriamine, triethylenetetromine, 1,4-diaminocyclohexane, xylylenediamine, bis(3-methyl-4-amino cyclohexyl)methane, N-aminopropylcyclohexylamine, N-dodecylethylene-diamine, N-hexadecylethylenediamine, N-Octylpropylenediamine, N-dodecylpropylene-diamine, N-tetradecylpropylenediamine, N-stearylpropylenediamine, N-decyldiethylenetriamine, N-hexadecyldiethylenetriamine, N-dodecyltriethylenetetramine, N-octyltripropylenetetramine, N-decyltripropylenetetramine, piperazine, N-aminoethylpiperazine, N-aminopropylpiperazine, N-aminopropylmorpholine, N,N'-diaminopropylpiperazine, tris(N-aminopropyl)isocyanurate, etc.

Among useful glycidyl ethers or glycidyl esters there are alkylglycidylethers such as n-butylglycidylether, iso-butylglycidylether, hexylglycidylether, hexadecylglycidylether, etc., cycloalkylglycidylether such as cyclohexylglycidylether, etc., arylglycidylether such as phenylglycidylether, benzylglycidylether, o-phenylphenol-glycidylether, cinnamylglycidylether, etc., alkenylglycidylether such as allylglycidylether, crotylglycidylether, etc., glycidylalkylate such as glycidylbutylate, glycidylcaproate, glycidylcaprylate, glycidyllaurate, etc., glycidylalkenate such as glycidylmethacrylate, glycidylacrylate, glycidyl-crotonate, etc., and glycidylarylate such as glycidylbenzoate, glycidyl-$\alpha$-benzylacrylate, glycidylbenzylacetate, etc.

The reaction products described therein may be obtained by heating the reaction system of ammonia or amines with glycidylether or glycidylester. The reactants react almost quantitatively, easily and in a short time. The desensitizer containing the reaction products thus obtained can be used in the various forms of ink for letterpress, gravure, offset and flexographic printing, of solution to be sprayed obtained by dissolving in a proper solvent, and of solid obtained by mixing and temper with paraffin, japan wax and white pigment.

As vehicles for preparation of a desensitizing ink, there may be included drying oils such as linseed oil and soybean oil; synthetic drying oils such as copolymerization oil of drying oil and styrene, dehydrated castor oil and urethanated oil; synthetic resins such as alkyd resin, polyester resin, polyamide resin and maleic acid resin; and mixture thereof.

Without limiting this invention, the following examples are given to illustrate the model of operation.

EXAMPLE 1

32.6g (0.1 mol.) of N-stearylpropylenediamine (MW=326) was heated to 80°C to melt in a four neck flask which had a refllux condenser, a thermometer and stirrer. To the above melt, 35g (0.307 mol.) of allylglycidylether (MW=114) was added drop by drop. As the reaction was exothermic, heating was stopped and allylglycidylether was added drop by drop at such speed that the system was kept in the temperature range of 80°–110°C. Then the system was heated at 110°C for 30 minutes and then excess allylglycidyl ether was removed by distillation. Finally, pale yellow and viscous N-stearyl-N,N',N'-tris(2-hydroxy-3-allyloxypropyl)propylenediamine having the following formula was obtained.

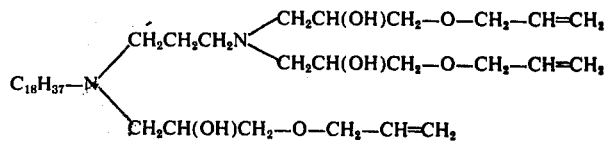

EXAMPLE 2

24.1g (0.1 mol.) of hexadecylamine (NW=241) and 23.5g (0.206 mol.) of allylglycidylether (MW = 114) were allowed to react with each other in the same manner as in Example 1 and thereby N,N-bis(2-hydroxy-3-allyloxypropyl)N-hexadodecylamine having the following formula was obtained.

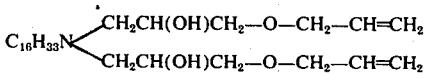

EXAMPLE 3

32.6g (0.1 mol.) of N-stearylpropylenediamine (NW=326) and 46g (0.307 mol.) of phenylglycidylether (MW=150) were allowed to react with each other in the same manner as in Example 1 and thereby N-stearyl-N,N',N'-tris(2-hydroxy-3-phenoxypropyl)propylenediamine having the following formula was obtained.

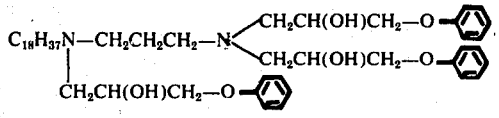

EXAMPLE 4

32.6g (0.1 mol.) of N-stearylpropylenediamine (MW=326) and 43.5g (0.306 mol.) of glycidylmethacrylate (MW=142) were allowed to react with each other in the same manner as in Example 1 and thereby N-stearyl-N,N',N'-tris(2-hydroxy-3-methacryloyloxypropyl) propylenediamine having the following formula was obtained.

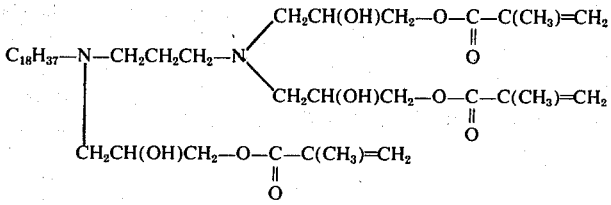

EXAMPLE 5

32.7g (0.1 mol.) of N-hexadecyldiethylene triamine (MW=327) and 53g (0.408 mol.) of butylglycidylether (MW=130) were allowed to react with each other in the same manner as in Example 1 and thereby N-hexadecyl-N,N',N',N'-tetrakis(2-hydroxy 3-butyloxypropyl)diethylenetriamine having the following formula was obtained.

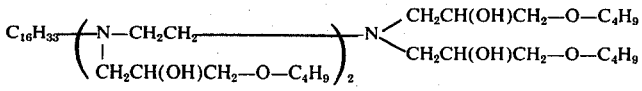

EXAMPLE 6

1 mol. of N-decyltripropylene tetramine and 5 mol. of benzyl-glycidylether were allowed to react with each other in the same manner as in Example 1 and thereby the compound having the following formula was obtained.

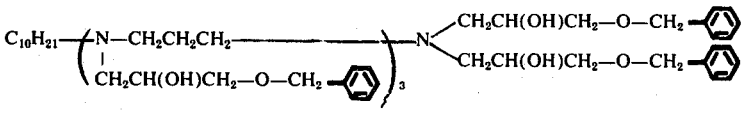

EXAMPLE 7

1 mol. of N-aminoethylpiperazine and 3 mol. of glycidylcaprylate were allowed to react with each other in the same manner as in Example 1 and thereby the compound having the following formula was otbained.

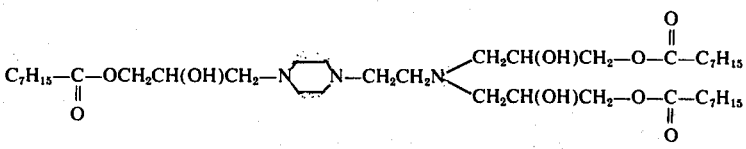

EXAMPLE 8

1 mol. of triethylenetetramine and 6 mol. of cyclohexylglycidylether were allowed to react with each other in the same manner as Example 1 and thereby the compound having the following formula was obtained.

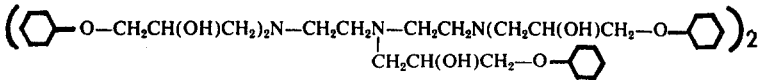

EXAMPLE 9

1 mol. of N,N'-diaminopropylpiperazine and 4 mol. of glycidylbutylate were allowed to react with each other in the same manner as in Example 1 and thereby the compound having the following formula was obtained.

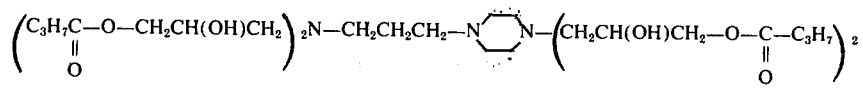

A desensitizing ink was prepared with use of each compound obtained in Example 1–9, and the formulation thereof is given below.

| | |
|---|---|
| linseed oil modified alkyd resin | 40 parts by weight |
| titanium oxide (anatase) | 25 parts by weight |
| compound obtained in Example 1–9 | 35 parts by weight |

Control

A desensitizing ink was prepared according to the following formulation:

| | |
|---|---|
| water-soluble varnish | 40 parts by weight |
| titanium oxide (anatase) | 25 parts by weight |
| compound below | 35 parts by weight |

with use of N,N,N'-trihydroxyethyl N'-steallylpropylenediamine having the following formula.

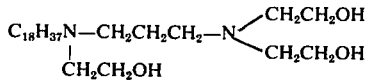

Separately, the capsular coating color was produced by steps of dissolving 2 parts of crystal Violet lactone and 1 part of benzoyl leuco methylene Blue in arkyl naphthalene derivative, and of the conventional encapsulation. Such a pressure-sensitive recording sheet was prepared that the back surface was coated with the above-mentioned capsular coating color by weight of 5g/m² on dry basis and the front surface was coated with active clay by weight of 5g/m² on dry basis (hereinafter referred to as "middle sheet"). Each desensitizing ink obtained in Example 1–9 and Control was applied locally by letterpress printing onto the said active-clay-coated surface, and then examined with regard to the properties thereof. Results are given below.

| | Effectivity (1) | Migration Resistance (2) | Rupture of Capsules (3) |
|---|---|---|---|
| Example 1 | good | good | scarcely observed |
| Example 2 | good | good | scarcely observed |
| Example 3 | good | good | scarcely observed |
| Example 4 | good | good | scarcely observed |
| Example 5 | good | good | scarcely observed |
| Example 6 | good | good | scarcely observed |
| Example 7 | good | good | scarcely observed |
| Example 8 | good | good | scarcely observed |
| Example 9 | good | good | scarcely observed |
| Control | good | scarcely color formed | remarkably observed |

Note:
(1) 6 sheets of the said desensitized pressure sensitive recording middle sheet were put one upon another, and then the pressure was applied by typewriting. The effect of inactivating color-forming ability in desensitized area of each sheet was evaluated.
(2) 20 sheets of the pressure sensitive recording middle sheet and the said desensitized pressure sensitive recording middle sheet were put alternately one upon another. The obtained set of sheets was allowed to stand at room temperature and 90% R.H. for 20 days, and then only the said pressure sensitive recording sheets applied no desensitizing ink were took out from the treated set. Some of them were superimposed and the pressure was applied thereto by typewriting. Image density of each sheet was evaluated.
(3) The spontaneous rupture of capsules was examined in such a way that the capsule-coated surface of a middle sheet which had been allowed to stand at the conditions of Note (2) was observed under a microscope.

On the other hand, each of the desensitizing inks obtained in Examples 1 to 9 and Control was applied by letterpress printing locally onto the surface of each middle sheet which has a color acceptor layer formed by using phenolformaldehyde resin, zinc phenylsalicylate, or a mixture of zinc 3-[4'-(α,α-dimethylbenzyl)-phenyl]-5-(α,α-dimethylbenzyl) salicylate with zinc oxide instead of using activated clay. Each ink of Examples showed the superior effect on ink setting. The ink of Control, however, remained sticky for a long time and showed the inferior effect on ink setting.

Desensitizing effectiveness, migration resistance and spontaneous rupture of capsules were examined in the same manner as in the case of using activated clay. Each of the desensitizing ink of Examples exhibited superior results as in Table 1. As to a desensitizing ink of Control, migration resistance is inferior and the spontaneous rupture of capsules occurred remarkably.

What we claim is:

1. A method of desensitizing a pressure sensitive recording sheet comprising applying to a predetermined area of the pressure sensitive recording sheet a desensitizer which comprises a reaction product produced by the reaction of (1) ammonia, alkylamines, alkyleneamines selected from the group consisting essentially of ethylenediamine, propylenediamine, hexamethylenediamine, diethylenetriamine and triethylenetetramine, alkenylamines, cyclicamines or arylamines with (2) one member selected from the group consisting of alkylglycidylethers, cycloalkylglycidylethers, arylglycidylethers, alkenylglycidylethers, glycidylalkylates, glycidylalkenates and glycidylarylates.

2. A method of desensitizing a pressure sensitive recording sheet as defined in claim 1, in which said desensitizer is applied in the form of an ink to said area of said pressure sensitive recording sheet.

3. A method of desensitizing a pressure sensitive recording sheet as defined in claim 2, in which said desensitizer is applied in the form of an ink with an oil vehicle to said area of said pressure sensitive recording sheet.

4. The process of claim 1, wherein said step of applying comprises dissolving said reaction product in the solvent to form a solution and spraying said solution.

5. The process of claim 1, wherein said step of applying comprises using said reaction product in the solid form wherein said desensitizer is mixed and tempered with paraffin, japan wax and white pigment.

6. The method of claim 1, wherein said step of applying comprises dissolving said reaction product in a solvent to form a solution and spraying said solution.

7. The method of claim 1, wherein said step of applying comprises using said reaction product as a solid form wherein the densitizer is mixed and tempered with paraffin, japan wax and white pigment.

8. A partly desensitized, pressure sensitive recording sheet which is obtained according to the method defined in claim 1.

9. A method of desensitizing a pressure sensitive recording sheet comprising applying to a predetermined area of the pressure sensitive recording sheet a desensitizer which comprises a reaction product produced by the reaction of (1) ammonia, alkylamines, alkenylamines, cyclicamines or arylamines with (2) one member selected from the group consisting of alkylglycidylethers, cycloalkylglycidylethers, arylglycidylethers, alkenylglycidylethers, glycidylalkylates, glycidylalkenates and glycidylarylates.

* * * * *